US005174908A

United States Patent [19]

King et al.

[11] Patent Number: 5,174,908

[45] Date of Patent: Dec. 29, 1992

[54] NON-REVERSIBLE SLIDING GATE, VALVE AND METHOD

[75] Inventors: Patrick D. King, Rantoul; Gary R. Polk, Champaign, both of Ill.

[73] Assignee: Flo-Con Systems, Inc., Champaign, Ill.

[21] Appl. No.: 693,915

[22] Filed: Apr. 29, 1991

Related U.S. Application Data

[63] Continuation of Ser. No. 494,779, Mar. 16, 1990, Pat. No. 5,052,598, which is a continuation-in-part of Ser. No. 319,410, Mar. 3, 1989, abandoned.

[51] Int. Cl.[5] ..... B22D 41/34

[52] U.S. Cl. ..... 222/600; 222/590

[58] Field of Search ..... 222/590, 591, 600, 597; 266/236; 164/335, 337

[56] References Cited

U.S. PATENT DOCUMENTS

| | | | |
|---|---|---|---|
| 311,902 | 2/1985 | Lewis | 222/600 |
| 808.810 | 1/1906 | Brookfield | 266/236 |
| 1,944,611 | 1/1934 | Reinartz et al. | 222/600 |
| 3,731,912 | 5/1973 | Kutzer | 222/600 |
| 3,765,579 | 10/1973 | Cramer et al. | 222/600 |
| 3,779,431 | 12/1973 | Tinnes et al. | 266/236 |
| 3,866,806 | 2/1975 | Shapland, Jr. | 222/600 |
| 3,918,613 | 11/1975 | Shapland et al. | 222/600 |
| 4,168,790 | 9/1979 | Lothmann et al. | 222/600 |
| 4,415,103 | 11/1983 | Shapland et al. | 222/600 |
| 4,545,512 | 10/1985 | Shapland et al. | 222/600 |
| 5,011,050 | 4/1991 | Verel | 222/600 |

FOREIGN PATENT DOCUMENTS

| | | |
|---|---|---|
| 2104561 | 2/1972 | Fed. Rep. of Germany . |
| 2702436 | 7/1977 | Fed. Rep. of Germany . |
| 3033977 | 7/1977 | Japan . |
| 6606230 | 11/1896 | Netherlands . |

*Primary Examiner*—Scott Kastler
*Attorney, Agent, or Firm*—Jack E. Dominik

[57] ABSTRACT

A slide gate having an offset teeming orifice for use in a sequential sliding gate valve having asymmetrical means for inserting said gate along a direction of loading in which the slide plate has asymmetrical means for engaging the asymmetrical means for loading and thereby insure proper orientation of the gate when loading.

42 Claims, 11 Drawing Sheets

68
12
15
65
69
60
14
64
67
70
62
66

16
75
76
18
72
74

88
36
34
35

80
27
86
82
28
28
79
84
17
86
27
82
77
96
98
78
77
85
80
86

86
80
81
96
98
85
96
78
77
80
79
98
85

14
96
96
96
96
78
98
98
98
98
100
98
98
100

NON-REVERSIBLE SLIDING GATE, VALVE AND METHOD

CROSS-REFERENCE TO RELATED APPLICATION

This application is a Rule 60 continuation application of Ser. No. 494,779 now U.S. Pat. No. 5,052,598 filed Mar. 16, 1990 entitled "Sliding Gate Three Plate System, Valve, Refractories and Method", which in turn is a continuation-in-part or application Ser. No. 319,410 now abandoned filed Mar. 3, 1989, and entitled "Non-Reversible Sliding Gate" now abandoned.

FIELD OF THE INVENTION

The present invention relates to sliding gate valves, and more particularly that type known as a tundish valve for the teeming of steel from a tundish into a continuous caster mold. Other usages are contemplated, but this usage and that as exemplified by U.S. Pat. No. 4,415,103 are more typical.

SUMMARY OF THE PRIOR ART

The prior art is best exemplified by U.S. Pat. No. 4,415,103 which relates to a three plate system in which there is an upstream stationary plate, a downstream tube holder, and a sliding gate plate which moves between the stationary plate and the tube holder as their respective orifices pass in and out of alignment or throttling alignment for the teeming of steel. In particular, when the offset orifice is used in the slide gate, and it is used for throttling, if it gets installed in reverse configuration and an emergency develops, the "panic button" to send it to full shut off does just the opposite, it sets it to maximum flow. In the environment of a steel mill, when such an emergency occurs, the likelihood of cool heads analyzing the situation may be remote, and instances of running stoppers such as described have occurred. It is also possible to reverse the stationary plate as well as the tube holder. In the case of the stationary plate this may or may not be a problem as pointed out in U.S. Pat. No. 4,063,668 where the plates are actually designed to be reversed. But with the tundish-type three plate applications reversal can lead to problems. Accordingly, an ultimate and ideal goal is the provision of a three plate system in which none of the plates can be installed upside down or reversed from their intended rightful positioning.

A further problem with the prior art three plate valve system is occasioned because the tube holder and its tube are normally inserted from the side in the same manner as the slide gate is loaded. Particularly when the tube extends down some distance, it necessitates raising the tundish in order to put the tube holder and tube into position in the valve and then lower the same again above the mold so that the tube extends into the molten metal in the continuous caster mold. Any time the tundish is raised or lowered it can change the rate of flow of steel into the continuous caster mold and upset the coordinated teeming of metal into the mold as well as its finely tuned related withdrawal rate. It, therefore, is highly desirable to have a three plate valve of the tundish type in which the tube and tube holder can be inserted robotically into the mold without raising the tundish, raised upwardly into position for firing into the valve,and then moved into the valve along with or without the slide gate.

SUMMARY OF THE INVENTION

The present invention is directed to a three plate system in sliding gate valves in which the stationary plate is essentially rectangular with one corner having a different configuration than the other three, and therefore keying into the correct insertion position at the upstream portion of the valve. The tube holder or lower stationary unit is essentially rectangular, and it has opposed corners of one configuration (mirror images of each other) and opposite corners of a different configuration, the same being proportioned for mating relationship with the valve structure. The sliding gate has an asymmetrical orifice as disclosed in U.S. Pat. No. 4,415,103. The slide gate also has asymmetrical feed rails on its lower portion which engage feed rails in the valve of differing widths to the end that when reversed the gate cannot be inserted. In addition to the non-reversible features just described, the invention contemplates the stationary plate as being asymmetrical with its longest face in the direction of exit of the slide gate to assist it in containing turbulence, and splash, at the time of insertion. The slide gate is asymmetrical on its face which coacts with the upper face of the tube holder. This facilitates, in the ready position having the leading edge of the slide gate overlapping the leadinq edge of the tube holder. The tube holder, in turn, is asymmetrical but the longest face is in the direction of the position of the ready slide gate to be inserted. Thus in operation, when the gate is loaded, the sliding gate portion is passed along the rails until its leading edge contacts the trailing edge of the operating gate. At this time the leading lower face of the slide gate overlaps the trailing edge of the tube holder face thereby positioning the slide gate for insertion and to displace the gate to be removed. At the time of insertion the steel entering the orifice in the outgoing slide gate will tend to tumble upwardly, and because the long length of the stationary plate is above this area, it provides a greater surface to inhibit splash. Furthermore, upon shut off, provision is made to drain from the slide gate through the tube holder and into the mold. Finally, the sliding gate is substantially the identical length of the tube holder so that the single cylinder which is used for exchanging the slide gate can also be used for removal and replacement of the tube holder. The valve itself has support and frame means for accommodating the just-described shapes of refractory. The valve in addition has releasable lock means in the ready plate area to receive a tube holder and tube by raising the same into position with or without a slide gate.

The method, contemplates the sequential usage in a three plate sliding gate valve of a single slide gate sandwiched between a stationary upper plate and a stationary tube holder in such a fashion that each one will mate with an offset "key portion" to thereby avoid reversal. The top plate leading edge in the direction of receiving the sliding gate is shortened, whereas the tube holder plate in the same direction is lengthened to the end that when the slide gate is moved into position it does not cause an excessive bending moment on the remote end of the tube holder plate and is in position to slide neatly in between the top plate and the tube holder plate once actuated in the direction of feed.

In view of the foregoing it is a principal object of the present invention to provide a three plate valve system in which the three plates, by their shape and coacting relationship with the valve frame, cannot be inserted in reverse or inverted configuration.

A major objective of the present invention, in a non-reversible environment, is to accommodate a tube change along the firing axis to thus permit a tube change without raising the tundish.

A further object of the present invention is to provide in a three plate system various asymmetrical relationships between the three refractories to the end that partial positioning takes place before full change of the slide gate. This avoids "bumping" and shock to the slide gate.

An additional object of the present invention is directed to proportioning the refractories in the subject three-piece gate to the end that turbulence upon ejection is contained and directed to an area which will maximize the containment and minimize the splash.

All of the above objectives are achieved with a valve, a method, and replaceable refractory inserts which are inherently no more expensive than the prior art.

BRIEF DESCRIPTION OF THE DRAWINGS

Further objects and advantages of the present invention will become apparent as the following description proceeds, taken in conjunction with the accompanying drawings, in which.

DESCRIPTION OF A PREFERRED EMBODIMENT

Prior to describing the details of the subject three plate valve, it should be observed that a major problem in the continuous castinq of steel relates to the chanqing of the submerged pour tube. In most valves of the prior art including U.S. Pat. No. 4,415,103, clearances are such and loading of the tube holder is such that in normal operations the tundish must be raised over the continuous caster mold in order to accomplish tube change. This can result in an interruption of the continuous caster, or at least a reduction in the speed of withdrawal which, in turn, can contribute to significant amounts of the product being scrapped or downgraded. Accordingly, it is highly desirable to be able to develop a tundish valve which, because of its inherent construction and tube holder, will permit the insertion of a submerged pour tube with its associated tube holder into the ready position in the tundish valve without having to raise the tundish, and thereafter move the newly placed tube holder and tube into operative position while withdrawing the spent tube holder and tube from the valve and the continuous caster mold. In addition, while the refractories would appear to dictate their own position in the valve, sometimes reversal has occurred. Thus it is highly desirable to develop a valve and method of operation which will eliminate the possibility of inserting any of the three basic refractory portions in the wrong orientation which, of course, can result in full open teeming at which time one would prefer to have a total shut off. Furthermore, during the shock of mounting a new tube holder, or mounting a new slide gate, or a combination of both, it is hiqhly desirable to cause the three refractories to interact in a mutually beneficial relationship. This is achieved by the present invention through the asymmetrical configuration of the tube holder in particular, but in combination with its coaction with the slide gate. The asymmetrical stationary plate is provided for the same purpose, and to assist in containing the splash of steel in an upstream direction which occurs after shut off that occurs during the first portion of a high speed sliding gate change.

For details of the environment of the subject valve, reference can be made to U.S. Pat. No. 4,415,103. It shows the position and orientation of the valve with reference to the vessel to which it is attached.

Figure 1:
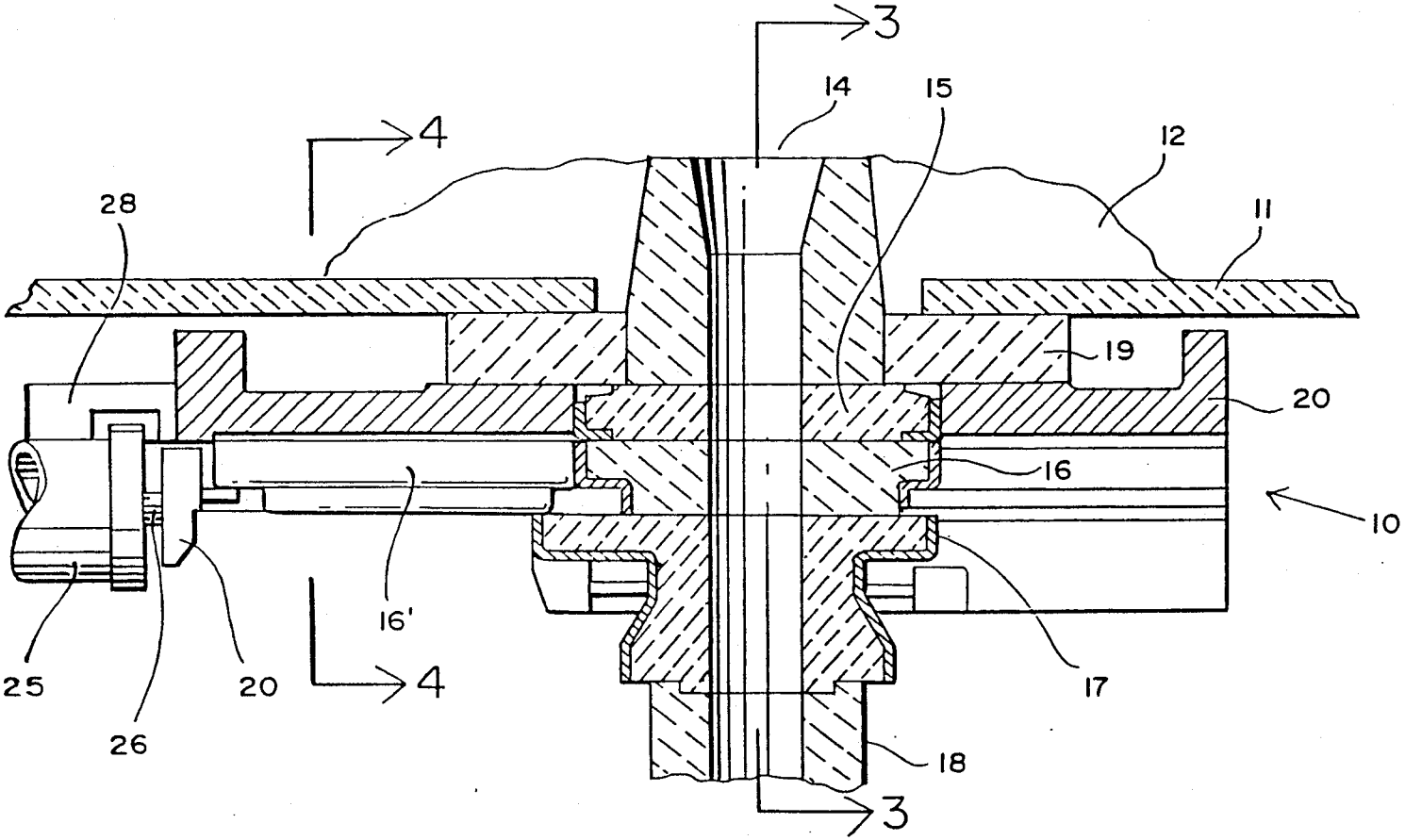
FIG. 1 is a longitudinal sectional view of the subject three-plate valve showing the three refractory members with their teeming orifices in full teeming alignment.

Turning now to FIG. 1 of the accompanying drawings, however, it will be seen that the valve 10 is secured to the vessel shell 11, which shell retains the vessel refractory lining 12. A well block nozzle 14 is positioned to traverse the vessel refractory 12 and shell 11 to the end that metal may be teemed directly to the stationary top plate 15. Beneath the stationary top plate 15 is a slide gate 16. The showing of slide gate 16' to the left of the slide gate 16 is to illustrate the ready position for the next slide gate to be inserted into the valve 10 when the expended. slide gate 16 is removed.

Beneath the slide gate 16 there is a tube holder 17 to which, in turn, is secured a tube 18. The tube 18 normally is of such a length that it will be submerged in the mold for the continuous caster over which the tundish is positioned. It is also contemplated that the tube holder 17 and tube 18 can be made from an isopress-type material, and be a one-piece unit. Thus, the showing is illustrative, but specific as to the configuration of the upper portion of the combination tube holder 17 and tube 18. The valve 10 is secured by means of mounting plate 19 to the vessel shell 11. The valve, in turn, has a main frame 20 which secures all of the elements together.

Figure 2:
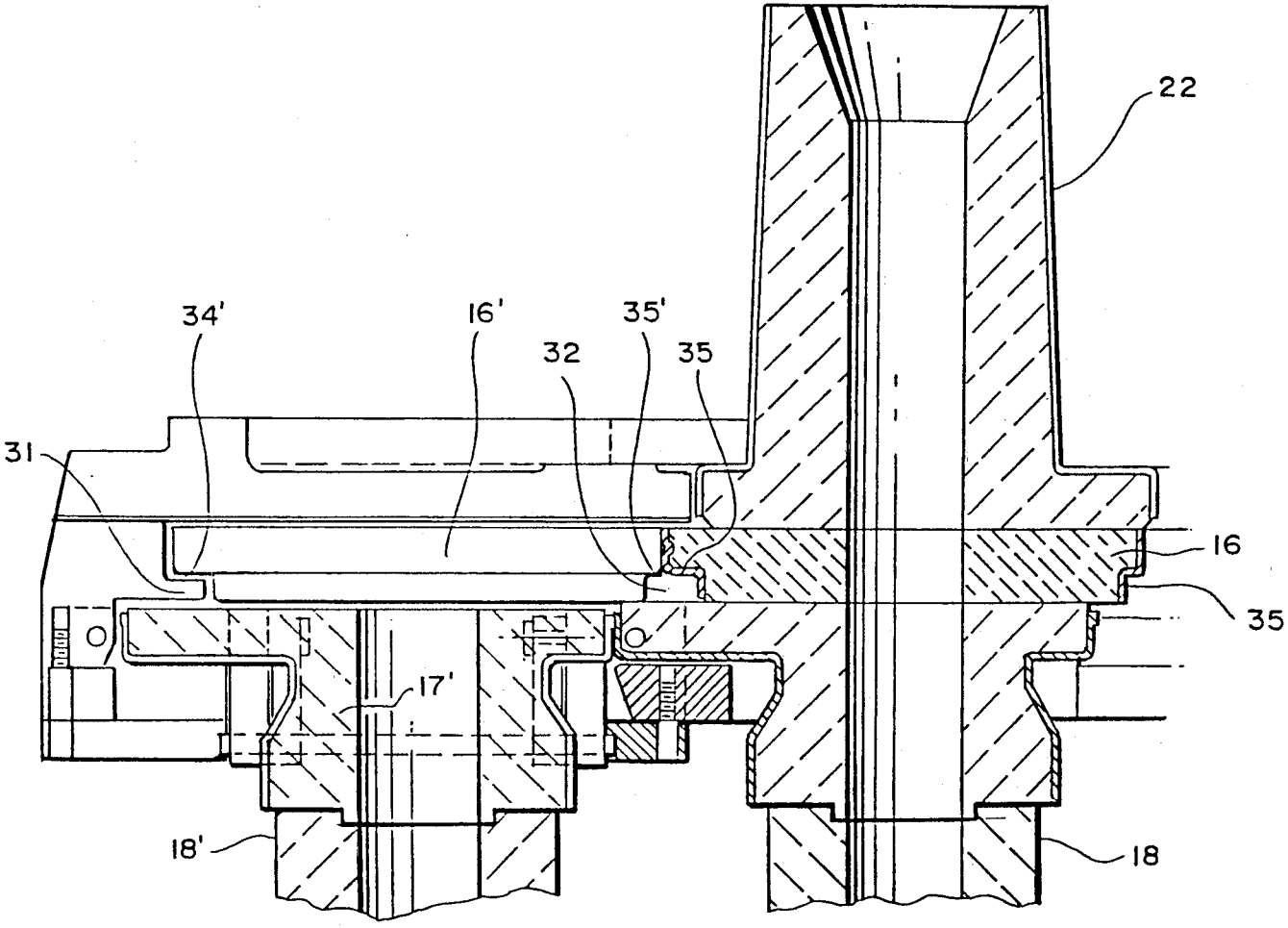
FIG. 2 is a view comparable to that of FIG. 1, but illustrating the position of both the incoming slide gate and the incoming tube holder and tube ready for gate change and/or tube change.
Figure 3:
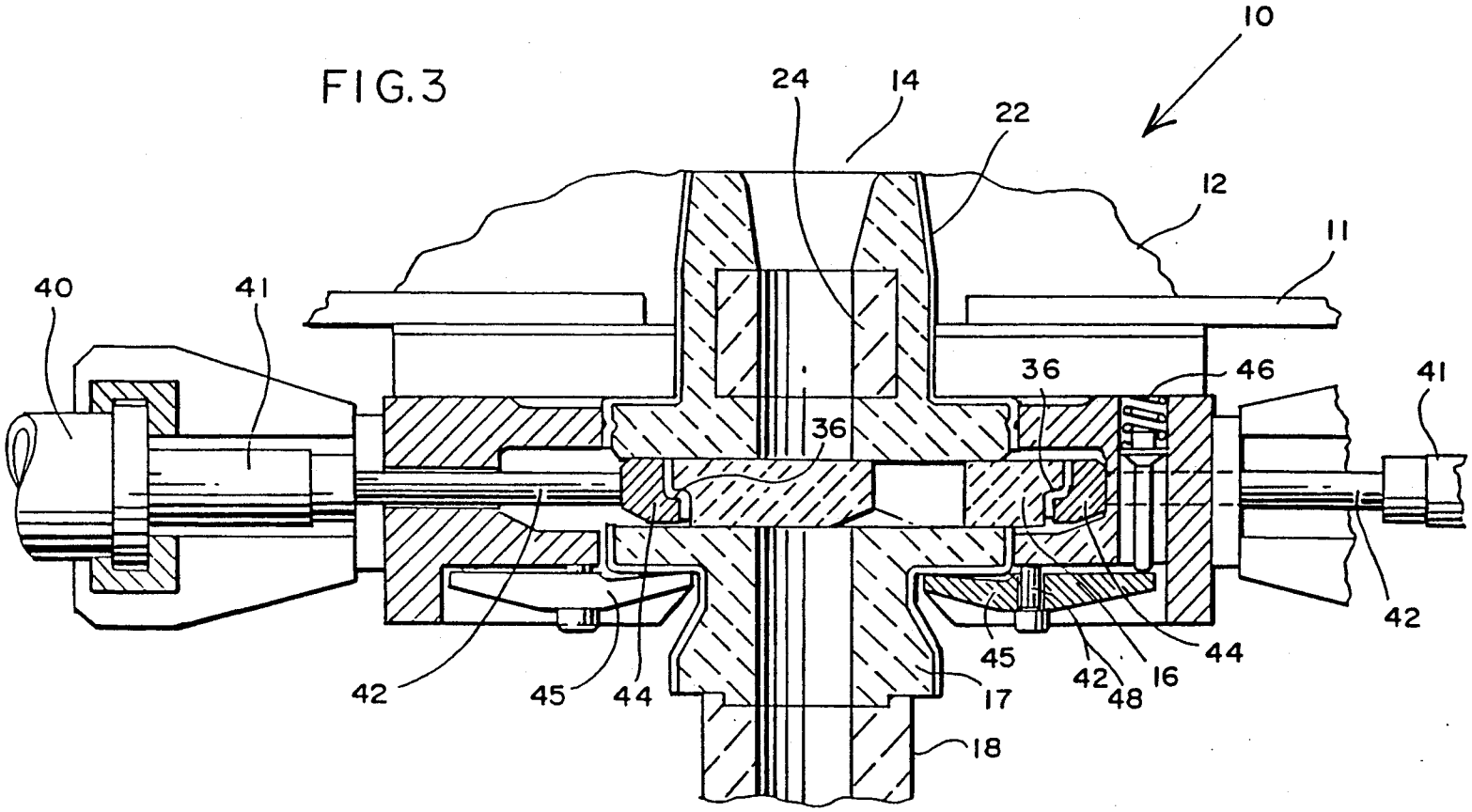
FIG. 3 is a transverse sectional view taken along section line 3—3 of FIG. 1 essentially, but showing the valve in the full throttle configuration.

Turning now to FIG. 2 which is a view comparable to that of FIG. 1, but showing the in place "ready" slide gate 16' and tube holder 17', it will be seen that a unitary well block nozzle and stationary plate 15 are shown and will be hereinafter referred to as nozzle plate 22. As shown in FIG. 3, an alternative embodiment nozzle plate 22 may be employed which utilizes a gas ring 24 for purposes of injecting an inert gas or other gas used in the teeming process.

In order to insert the in place sliding gate 16' as shown in FIG. 1, there is provided a plate change cylinder 25 which in turn drives a piston rod 26. The same is secured by means of cylinder mount 28 to either the vessel or to the main frame 20. Desirably it is secured to the main frame 20. A ram head 30 is secured to the piston rod 26, with the ram head 30 being proportioned at its upper, central, and lower portion to engage either the stationary plate 16' or the tube holder 17'.

Figure 4:
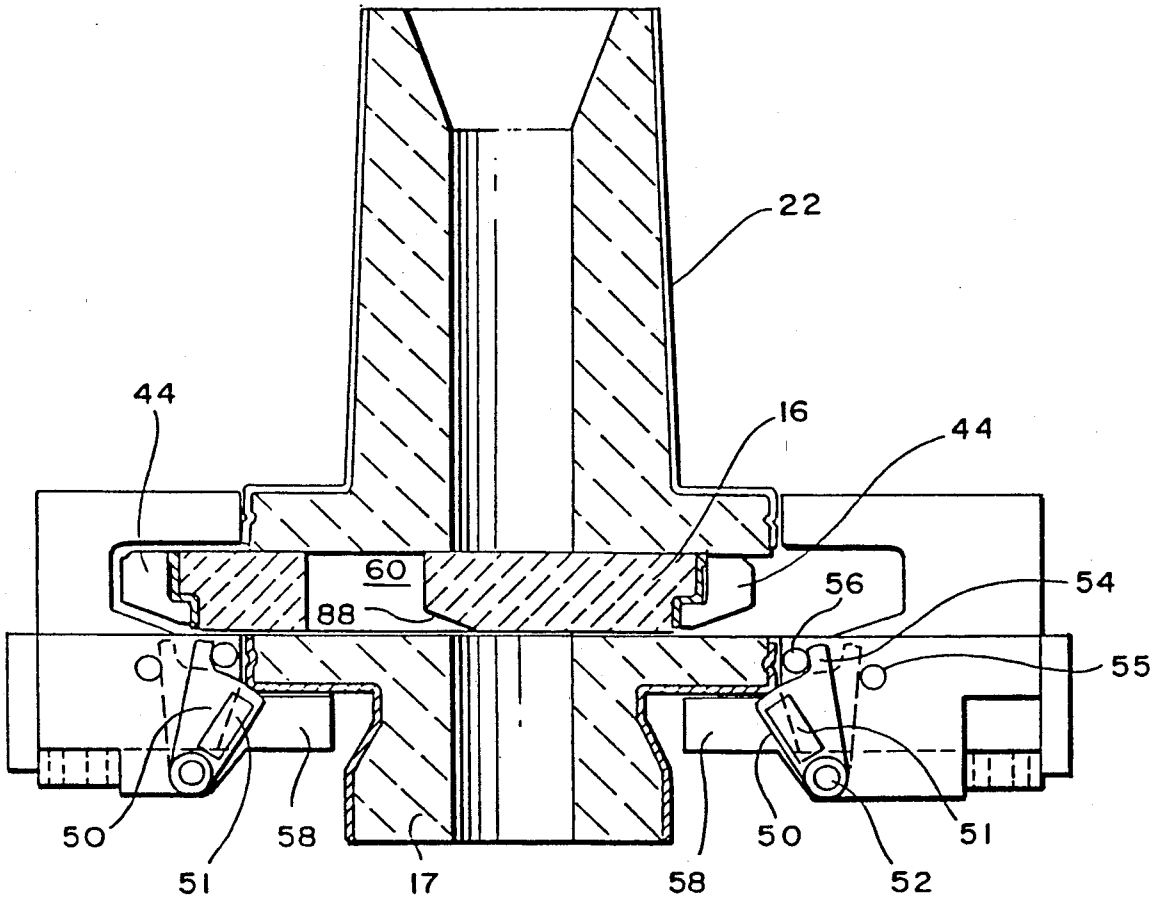
FIG. 4 is an alternative view of FIG. 3 taken from a different location such as section line 4—4 of FIG. 1 illustrating the loading latch relationship to the tube holder.

The provision for insuring the non-reversibility of the slide gate 16 is best illustrated in FIG. 2 where it will be seen that the ready slide gate 16' has been pushed into the loading area where it slides on top of long-loading rail 31 and the opposed short-loading rail 32. The respective loading rails engaqe the undercut on the long loading side 34 and the undercut on the short loading side 35. The reference numerals 34' and 35' relate to those undercuts on the ready slide gate 16'. The feed undercuts 36 are shown in FIGS. 3 and 4. These undercuts for purposes of feed are the same on the opposed sides of the slide gate 16.

Turning now in greater detail to FIG. 3, it will be seen that a regulating cylinder 40 is positioned on both sides of the valve 10 and drives by means of piston rod 41 through the regulating drive pin 42 which, in turn, activates the feed rails 44.

The pressure to hold the tube holder 17 in pressure relationship aqainst the slide gate 16 and the nozzle plate 22 and/or the stationary top plate 15 is provided by rocker arms 45 which are activated by a spring pad assembly 46 as shown in the right-hand portion of FIG. 3. The rocker arms 45 are secured by means of a rocker arm pivot 48 to the frame 20.

The loading of the tube holder 17, 17' and tube 18 relate to a significant aspect of the present invention. This is shown diagrammatically in FIG. 30. The tube holder 17 is loaded by means of a robot (not shown) by inserting the same downwardly into the continuous caster mold, and then promptly thereafter elevating the same towards the valve 10 where, as shown in FIG. 4, the loading latch 50 provided on both sides of the tube holder 17 first rotates against the weight of the tie bar weight 51 about the pivot pin 52 until the same engages the loading stop 55. Thereafter when the tube holder 17 is elevated to its appropriate position for feeding, the tie bar weight 51 causes the loading latch 50 to drop and the latch stop 54 of the loadinq latch 50 enqaqes the loading stop 56 putting the same in the position as shown in FIG. 4. At this point the tube holder 17 is positioned atop the loading latches 50. Thereafter, as illustrated in FIG. 2, the ram head 30 engages the tube holder 17 and pushes the same into position so that the entry tube holder 17' removes the operating tube holder 17. At the same time this occurs, the tube holder 17 engages the rocker arms 45 which secure the tube holder to the slide gate 16 as already described. In the throttling mode, as shown in FIG. 4, the sliding gate 16 has been moved by means of the feed rails 44 and their associated driye mechanism into a shut-off position so that the orifice 60 of the sliding gate 16 is blocked off from the orifice of the nozzle plate 22 and the teeming of steel is interrupted. It is in this configuration where the tube change is normally accomplished when the tube 17 is changed without removing the slide gate 16.

Figure 6:
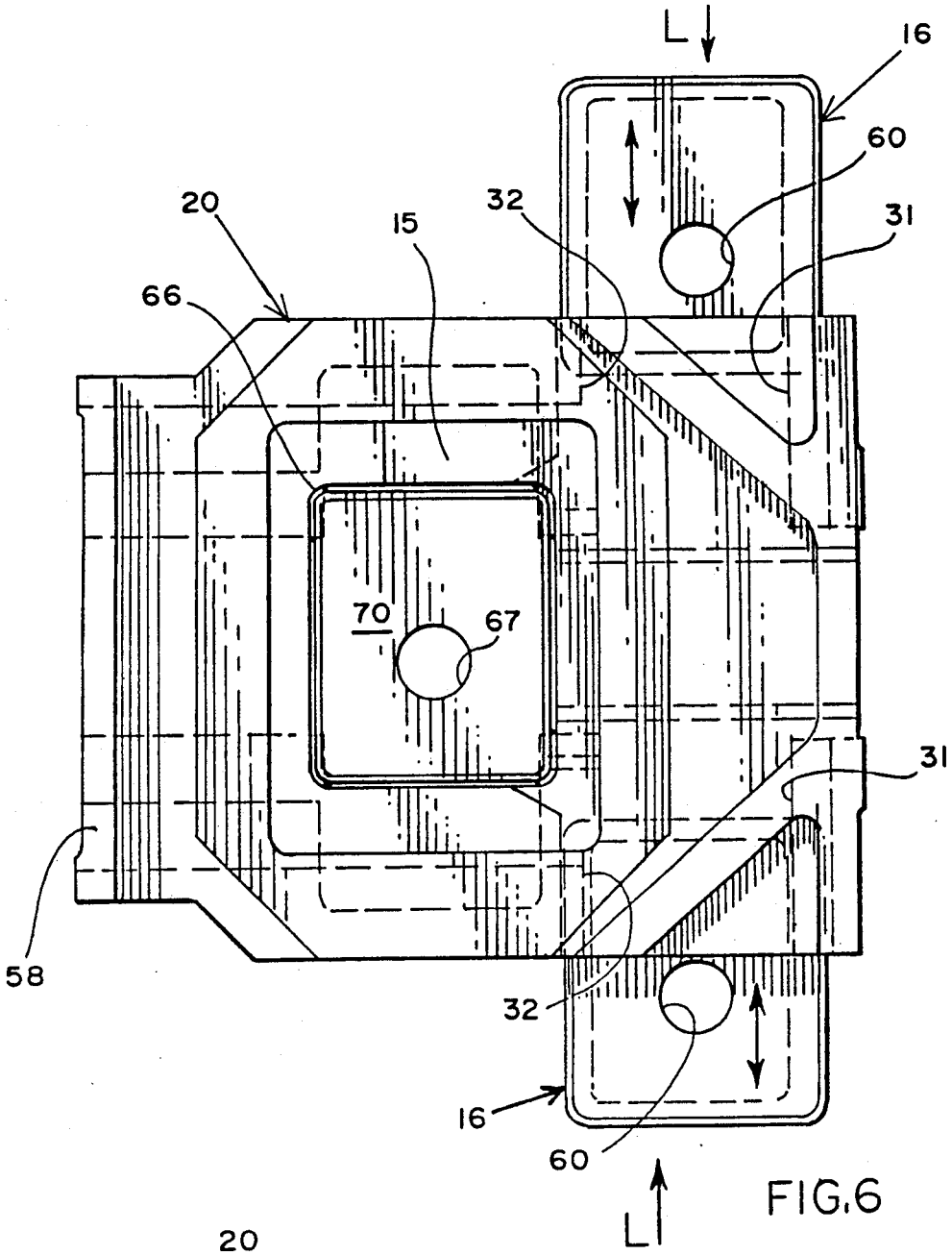
FIG. 6 is a view from upstream, of the main frame as shown in FIG. 5 illustrating how the same can be loaded from either the left side or the right side with the sliding gate.
Figure 5:
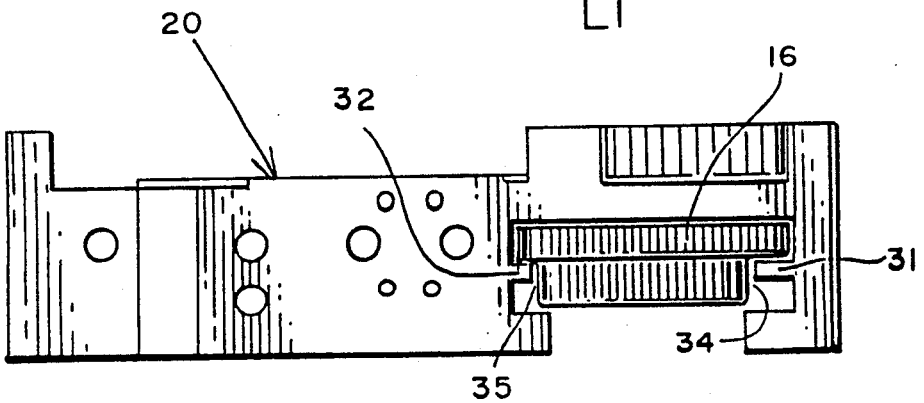
FIG. 5 is a side view of the main frame showing the slide gate in position on the two loading rails, one of which is long and one of which is short.
Figure 7:
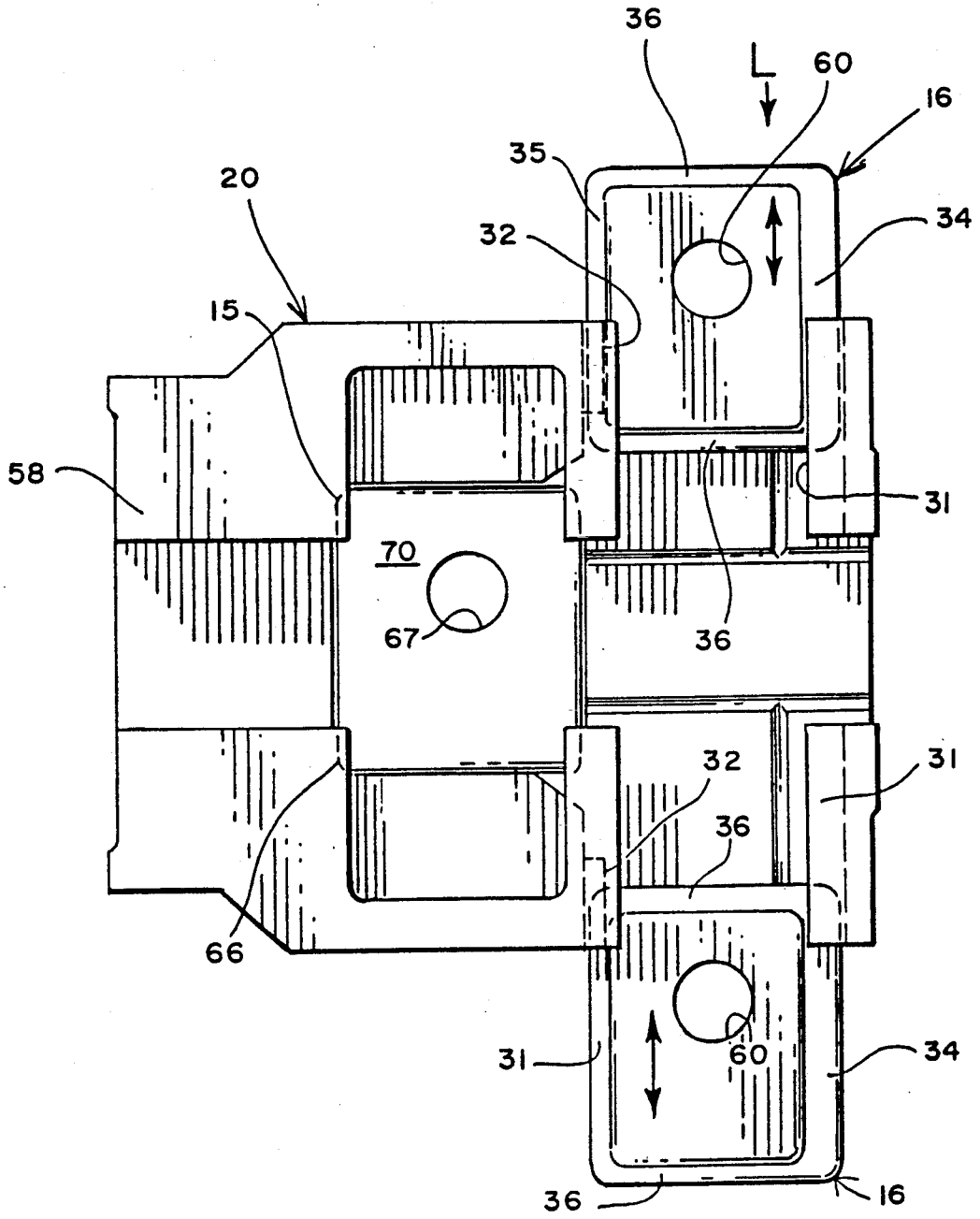
FIG. 7 is a view from downstream, of the same frame as shown in FIG. 6 and showing the same sliding gate members in their loading configuration.

For a somewhat better understanding of the loading of the slide gate 16, reference should be made to FIGS. 5, 6 and 7. Particularly in FIG. 5 there is a showing in the frame 20 of the long loading rail 31 and the short loading rail 32 which receive the slide gate 16. The long undercut 34 is atop the long rail 31, and the short undercut 35 is atop the short loading rail 32. Then as seen in FIG. 6, the slide gates 60 are loaded from either the left-hand side or the right-hand side of the valve, these sides being distinguished by an operator standing at the right-hand side of the frame 20 as shown in FIG. 6 and looking towards the exit end. To be noted is that the offset orifice 60 of the slide gates is in the same relative orientation irrespective of whether it is loaded from the left side or the right side. Finally, as noted in FIG. 7, which is a view from underneath the valve of the valve frame 20, the same elements are positioned with regard to the respective long loading rails 31 and short loading rails 32.

Figure 8:
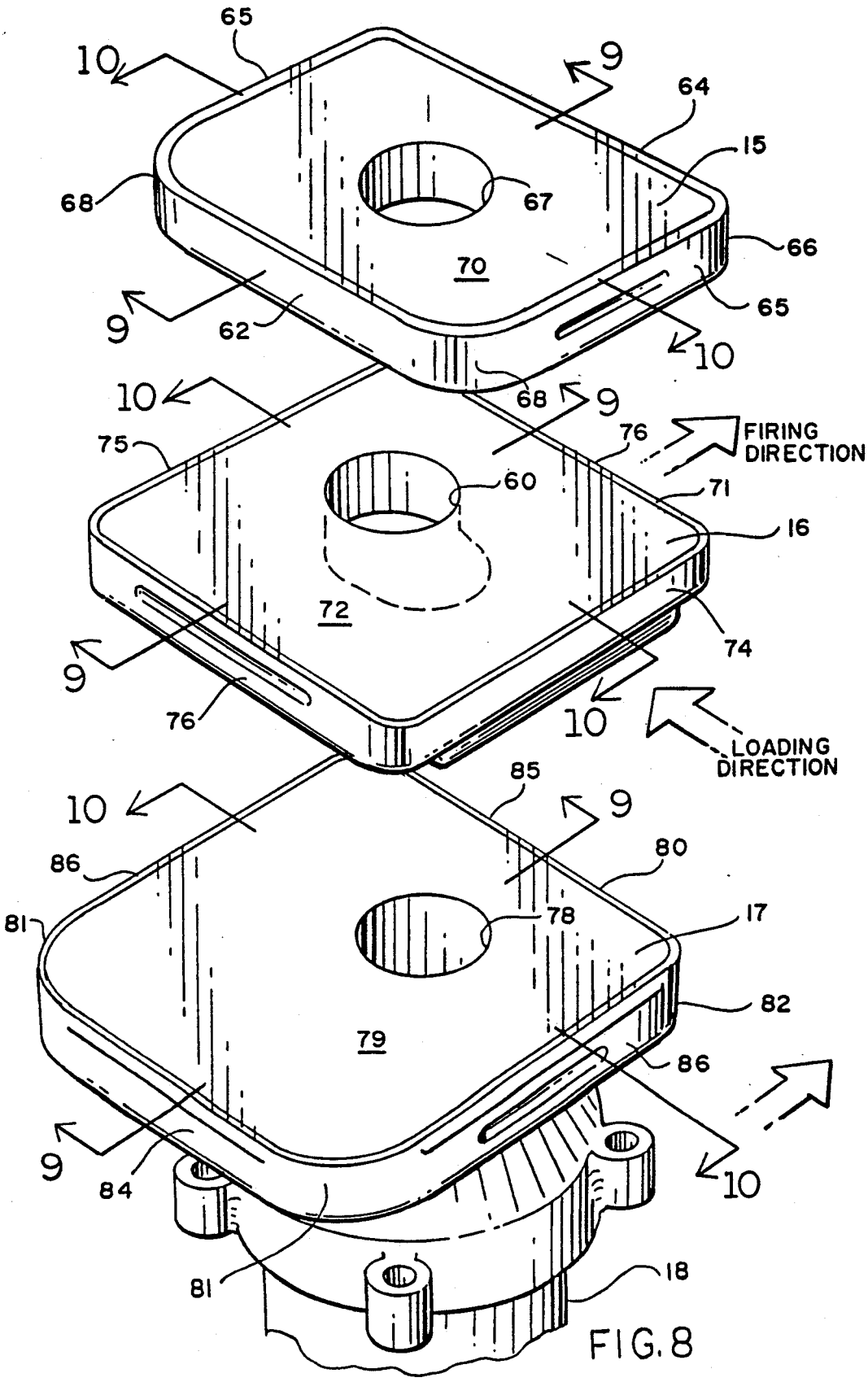
FIG. 8 is an exploded perspective view of the three refractories showing them coaxially aligned with the refractory members in top to bottom orientation being stationary plate, siding gate, and tube holder.

As the description of FIG. 8 proceeds, it will be noted that reference is made to each of the three refractory plates as having sides and ends. The sides are those opposed portions which parallel the axis of firing. The ends are those opposed portions which (for the slide gate and tube holder) are parallel to the axis of loading as distinguished from firing. In FIG. 8 the refractories are arranged from upstream to downstream in order of stationary top plate 15 (or nozzle plate 22); the slide gate 16; and the tube holder 17 with or without its associated tube 18. Beginning with the stationary plate 15, it will be seen that there is an entrance end 62, an exit end 64, and opposed sides 65. More specifically, the four corners include keying radius 66, the corners 68, all of which are enclosed by means of a frame 69 to the refractory slab 70. As to the corners 66, 68, the keying corner 66 is shown as having a shorter radius than the other three corners 68. What is important is that one corner have a key which matches with a related member in the frame 20 so that the orientation of the stationary plate is assured by putting the same in position. Since the stationary plate has a long side and a short side, this in combination with the keying radius 66 (or other key constructions such as half a hexagon, half a square, a key-like or spline-like member) will insure the proper orientation of the stationary plate 15.

Continuing on and moving downstream in FIG. 8, it will be seen that the slide gate 16 with its offset orifice 60, have a frame 71 which encases the refractory slab 72. The slide gate has a long side 74, and a short side 75. When reference is made to "long" or "short" it refers to the distance the side has with relationship to the central axis of the orifice 60. The ends 76 for the slide gate 16 are equally spaced on either side of the orifice 60.

Figure 9:
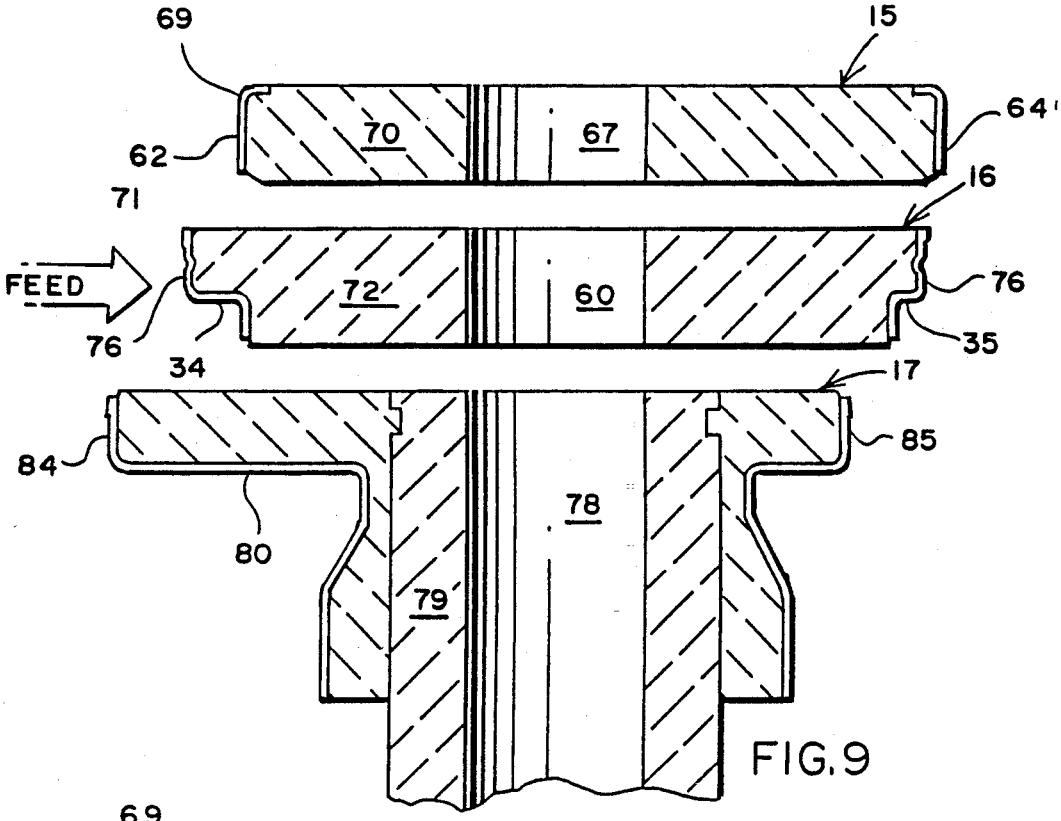
FIG. 9 is a longitudinal assembly view in sequence taken along section lines 9—9 of FIG. 8.
Figure 10:
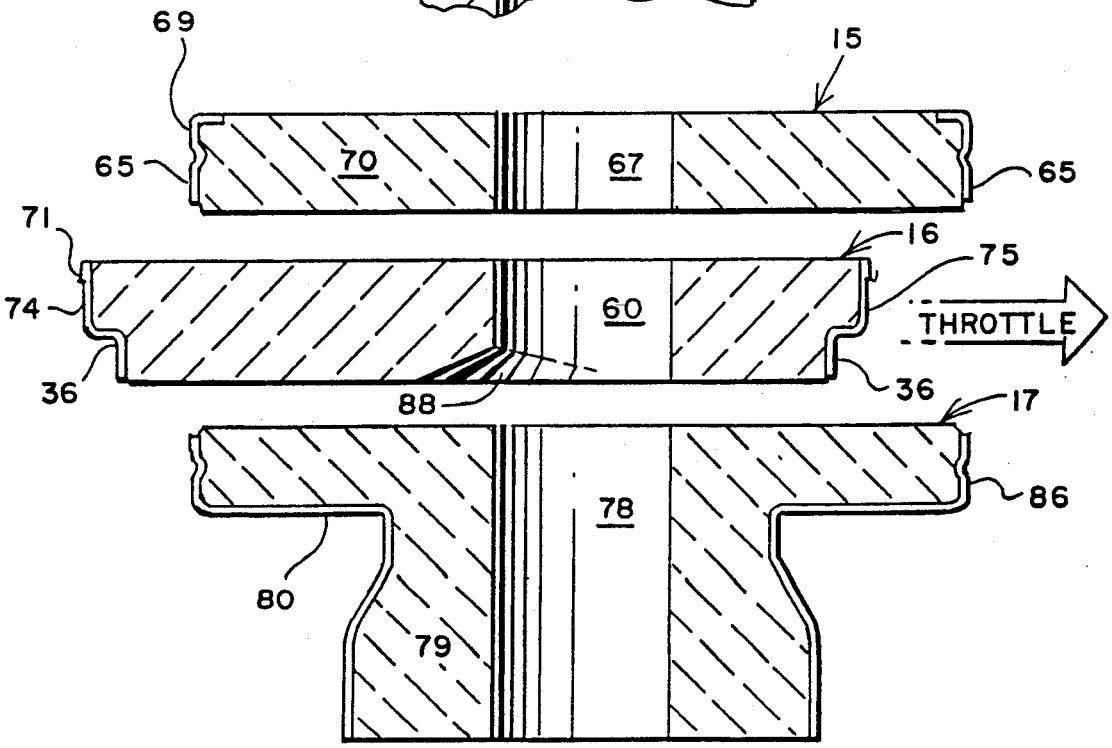
FIG. 10 is a transverse sectional view of the three refractories taken along section lines 10—10 of FIG. 8.

Finally, continuing further downstream in FIG. 8, it will be seen that the tube holder 17 has a tube holder orifice 78 located in the refractory block 79, and encased by the frame 80. A large radius corner 81 is provided, and a small radius corner 82 is provided. In this instance the small radius corners are opposed to each other, and the long radius corners 81 are opposed to each other. The entrance end 84 and the exit end 85 are positioned and oriented so that the entrance end 84 is a greater distance from the center of the orifice 78 than the exit end 85. This permits the incoming slide gate 16 to overlap the refractory 79 of the tube holder 17 prior to being fired into position. The tube holder sides 86 are equally spaced from the center of the orifice 78. This relationship is highlighted in FIGS. 9 and 10 which respectively show the feed relationship between the plates 15, 16, 17 in FIG. 9, and the throttling relationship of the plates 15, 16, 17 as shown in FIG. 10. There it will be seen that the long portion of the stationary plate 15 as shown in FIG. 9 is toward the exit end. It will be further seen that the difference between the exit and feed ends of the slide gate 16 are a function of the undercuts 34, 35 but as shown in FIG. 10, provision is made for a slide gate drain 88 which, as illustrated in FIG. 4, permits drainage of residual steel from the slide gate orifice 60 by means of the slide gate drain 88 shown as a tapered portion of the underneath face of the slide gate 16.

Figures 11, 12, 13, 14, 15, 16, 17, 18:
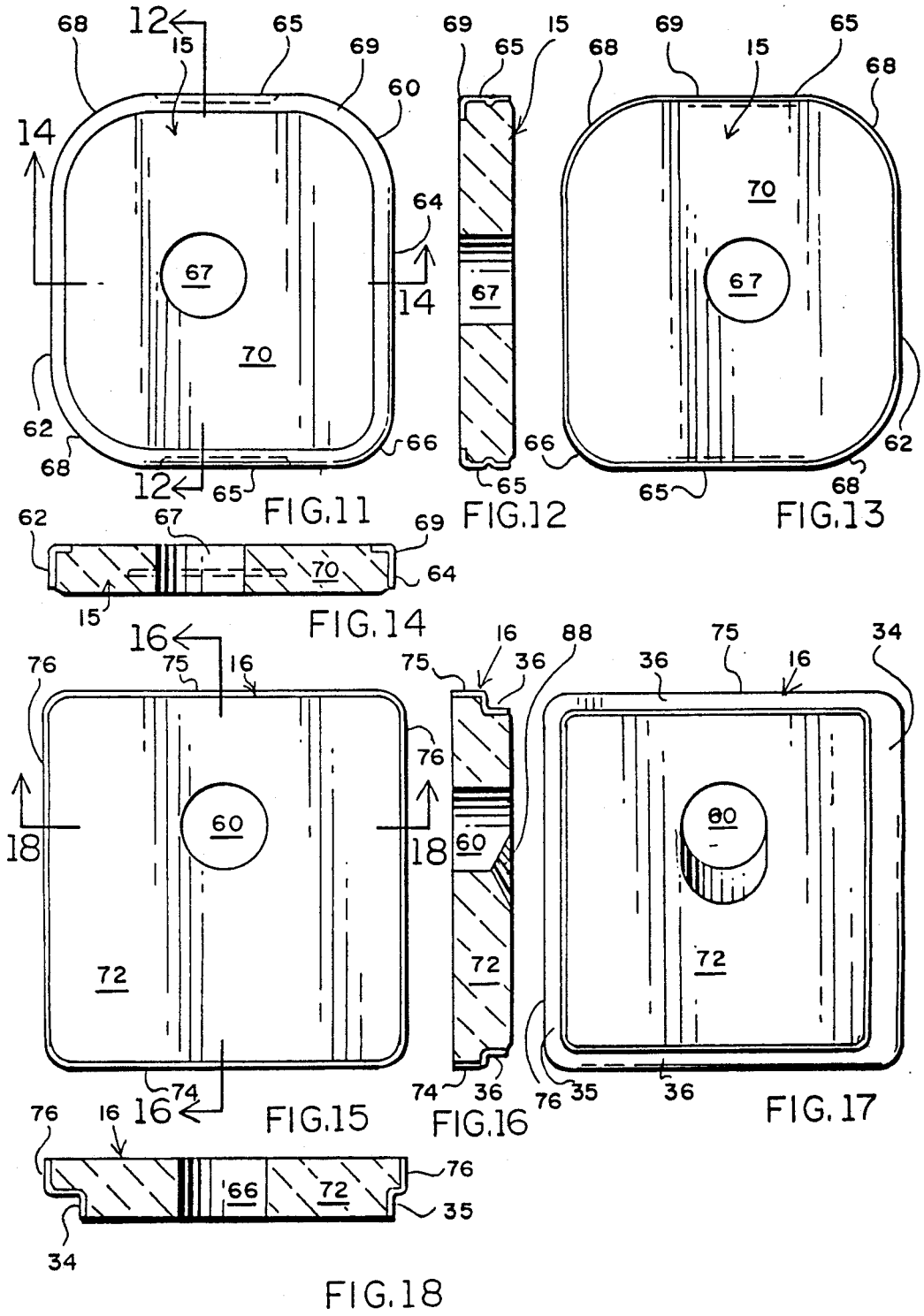
FIG. 11 is a view from upstream, of the stationary plate.
FIG. 12 is a transverse seotional view of the stationary plate taken along section line 12—12 of FIG. 11.
FIG. 13 is a view from downstream, of the stationary plate.
FIG. 14 is a longitudinal section view of the stationary plate taken along section line 14—14 of FIG. 11.
FIG. 15 is a view from upstream, of the slide gate.
FIG. 16 is a transverse sectional view taken of the slide gate along section line 16—16 of FIG. 15.
FIG. 17 is a view from downstream, of the slide gate.
FIG. 18 ls a longitudinal section view of FIG. 15 taken along section line 18—18 of FIG. 15.

FIGS. 11, 12 and 13 show the stationary plate with all of the reference numerals just described being identified. Again it will be seen that as to the stationary plate 15, three corners 68 which are substantially identical as to radius are provided, with a fourth corner 66 of a different and smaller radius which defines as the keying radius 66 or, in its alternative embodiment simply as a key 66. The sliding gate is shown in FIGS. 15, 16, 17 and 18. Highlighted is the drain 88 which appears particularly in the cross-section shown in FIG. 16, and the view from downstream, shown in FIG. 17.

Figures 19, 20, 21, 22, 23, 24, 25:
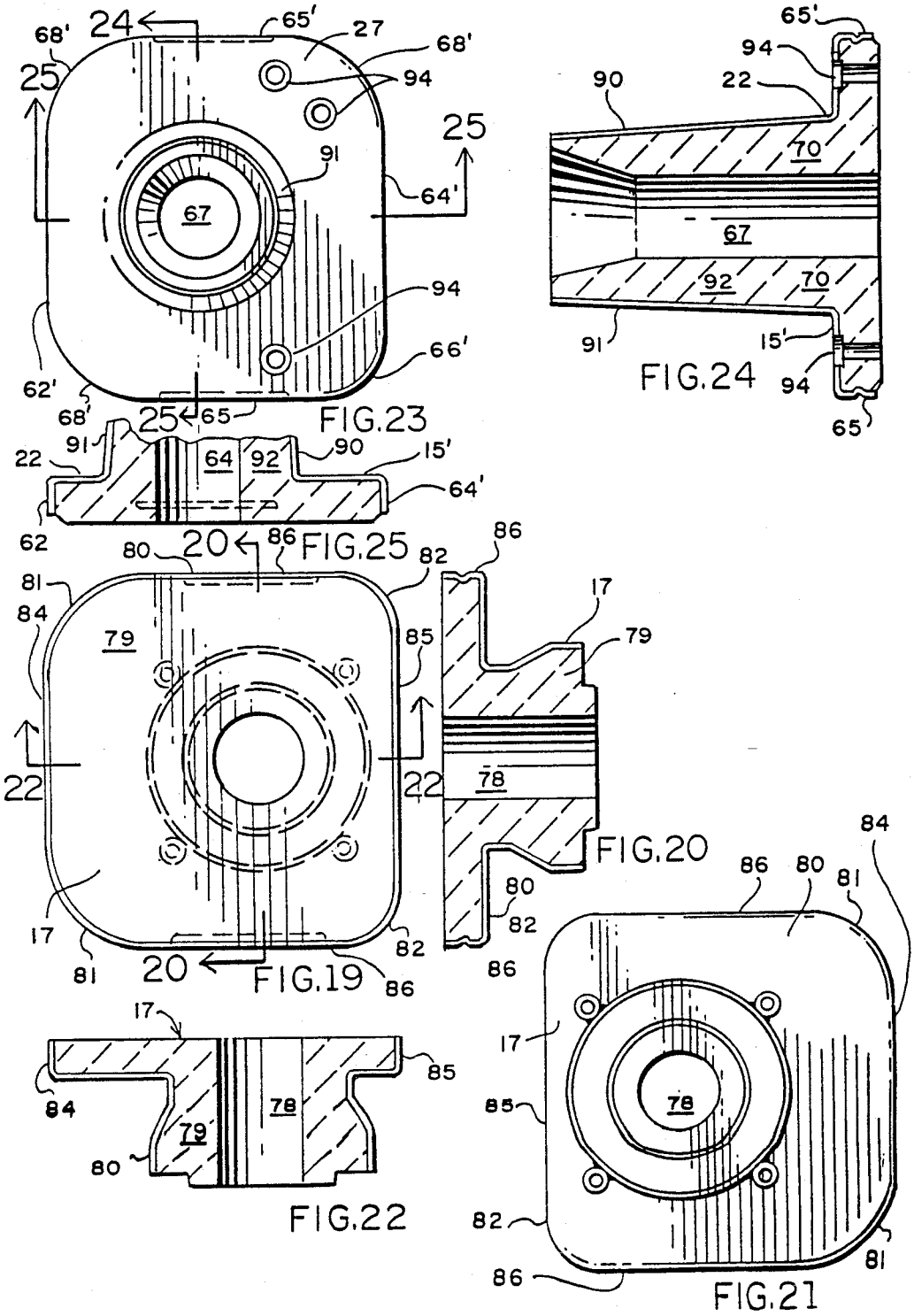
FIG. 19 is a view from upstream, of the tube holder.
FIG. 20 is a transverse section view of the tube holder of FIG. 19 taken along section line 20—20 of FIG. 19.
FIG. 21 is a view from downstream, of the tube holder of FIG. 19.
FIG. 22 is a longitudinal section view of the tube holder of FIG. 19 taken along section line 22—22 of FIG. 19.
FIG. 23 is a view from upstream, of the nozzle plate.
FIG. 24 is a transverse sectional view taken of the nozzle plate along section line 24—24 of FIG. 23.
FIG. 25 is a longitudinal section view of FIG. 23 taken along section line 25—25 of FIG. 23.

The nozzle plate 22 which is essentially a combination of the stationary top plate 15 with the well block nozzle 14 is best illustrated in detail in FIGS. 23–25. The view in FIG. 23 clearly shows the entrance end 62 and exit end 64, as well as the cross-section shown in FIG. 25 where the long and short ends are apparent. The sides 65 are illustrated in cross-section in FIG. 24, along with the gas passages 94 in the refractory for the plate portion. A frame 90 is provided which encases the bulk of the nozzle refractory 92 and the stationary plate refractory 70, with the refractories 92, 70 being integrated where manufacturing procedures for that purpose are employed. Otherwise separate refractories are used, with the same frame 90 for encasing them. Provision is made for gas passages 94 into the plate refractory 70 and through an upper portion of the frame 90 as best illustrated in FIGS. 23, 24.

Finally, specifics as to the tube holder 17 are shown in the four FIGS. 19–22. The relationship between the orifice 78 and the offset entrance ends 84 and exit ends 85 is clearly shown in FIG. 19 and FIG. 22. It is also illustrated in FIG. 21. The positioning of the key corners 82 opposed to the large radius corners 81 is well illustrated in FIGS. 19 and 21.

FIGS. 26–29 show an alternative embodiment unitary pour tube 90 with a tube holder head 77 characterized by a central orifice 78 and a refractory top plate 79 unitarily formed the tube 98. The frame 80 is essentially the same as the frame for the tube holder 17 described above. The tube holder head 77 has large radius corners 81 and small radius corners 82. The entrance end 84 and exit end 85 as well as the sides remain essentially the same as with the tube holder 17 described above. The advantage of this embodiment is its inherently low cost, and the elimination of two separate pieces which have to be joined either by the manufacturer or by the user prior to the insertion of the assembly into the valve.

According to the method of the present invention a valve 10 is provided with a stationary plate 15, a slide gate 16, and a tube holder 17. Each of these members is asymmetrical in one aspect or another. As to the stationary plate 15 and tube holder 17, they are symmetrical about the axis of feed, whereas they are asymmetrical about the axis of loading. The sliding gate, on the other hand, is asymmetrical about the axis of loading, and the axis of feed. The sliding gate 16 is asymmetrical about the axis of feed with regard to the positioning of the orifice 60 for purposes of throttling and the downstream face is asymmetrical with respect to the axis of loading. In practicing the method of the present invention, the stationary plate 15 and/or the nozzle plate 22 are positioned when the valve is detached from the vessel. Thereafter, the slide gate 16 and the tube holder 17 may either be exchanged together, or exchanged separately. What is important is that the tube holder is positioned from downstream and moved directly upstream and into position with a latching mechanism 50, and there is no need to raise the tundish vessel and the valve 10 for this purpose. The slide gate is loaded with its long and short undercuts 34, 35 matching the long and short loading rails 31, 32 to thus prevent reversal. In the event the operator wishes to exchange the slide plates and not the tube holder, a reserve tube holder 17' is not put into position prior to activating the plate change cylinder 25. On the other hand, if a tube holder 17 is to be replaced and no slide gate replaced, the tube holder is put into position with the latching assembly 50, and the ram head 30 engages the tube holder to change it out while the slide gate 16 remains in place.

Figures 26, 27, 28, 29, 30:
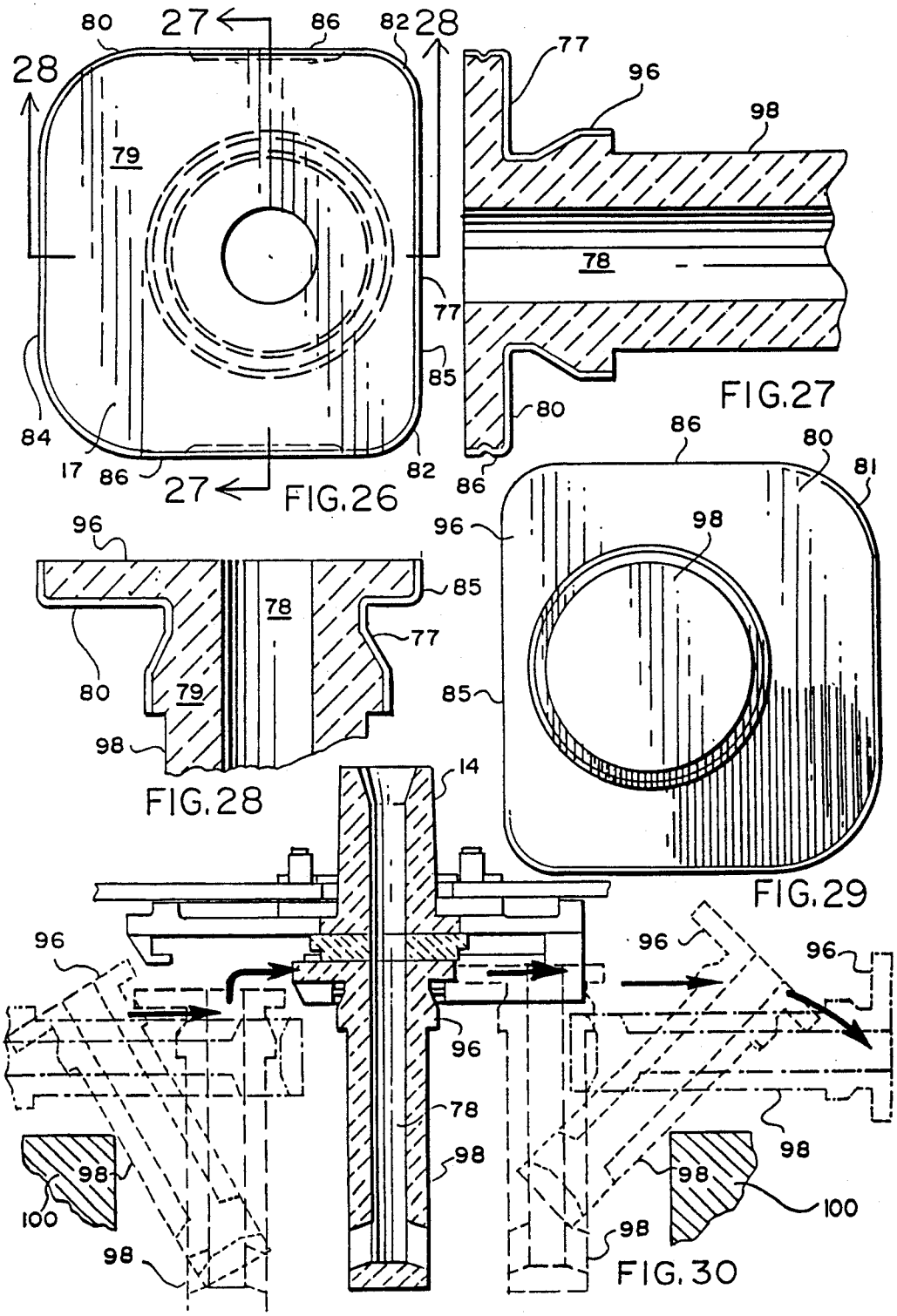
FIG. 26 is a view from upstream, of the tube holder assembly.
FIG. 27 is a transverse sectional view taken of the tube holder assembly on section line 27—27 of FIG. 26.
FIG. 28 is a longitudinal section view of FIG. 26 taken along section line 28—28 of FIG. 26.
FIG. 29 is a view from downstream, of the tube holder assembly as asymmetrical with respect to the access of loading.
FIG. 30 is a longitudinal section view of the valve showing diagrammatically the tundish and continuous caster mold and a diagrammatic slow motion frozen sequence of inserting and removing a tube and tube holder without lifting the tundish.

In the course of operating the subject valve, the sliding gate 16 change takes approximately 200 milliseconds (0.2 seconds). The tube change, on the other hand, as illustrated in FIG. 30, has a cylinder stroke of approximately two seconds. What is contemplated is a single robot (not shown) but of the type supplied by Cincinnati Milacron, which during phase one of the operation will lift the tube holder 17 and tube 18 (or the alternative embodiment of FIGS. 26–29) from a preheater where it is preheated to approximately the temperature of molten steel and transported promptly to loading in the load mode as shown sequentially in FIG. 30 until the same is latched into position by the loading latch 50. This entire activity takes approximately ten to fifteen seconds, and does not interrupt the flow of steel from the tundish to the continuous caster mold 100, as shown in FIG. 30. The robot then shifts its position to the exit side of the tundish valve to receive the tube holder 17 and tube 18 which is to be removed from the teeming orientation. Once the robot is in that position which is essentially at the right-hand side of FIG. 30, it signals phase two to change to firstly a high speed throttle effort to the "off" configuration which takes approximately one second. During the last portion of the "off" cycle the firing cycle for the tube holder 17 is initiated , the firing cycle of the tube holder being relatively slow a period of two seconds. Thereafter, as the tube holder is beginning to be moved into position and displace the operating tube holder, the high speed opening stroke of the throttle cylinder is actuated to full open to re-establish flow. Once the tube holder 17 is in place, and the spent tube holder exits onto its exit rails 58 for removal by the robot, the tube holder sequence is replaced by the normal level control sequence for the level of steel in the continuous caster mold 100. Throttling may or may not begin immediately for some time thereafter depending upon the level of steel in the casting mold 100.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A slide gate comprising, in combination, a frame of essentially rectangular configuration surrounding and retaining a refractory, a refractory inserted interiorly of and secured to said frame, said refractory having an orifice, ledges in asymmetrical configuration underneath the frame and refractory at the edge portions thereof, parallel thereto and defining the direction of loading, and ledges which are essentially in perpendicular relationship to the asymmetrical loading ledges defining the direction of feeding.

2. In the slide gate of claim 1, said refractory orifice being offset along the intended axis of throttling.

3. In the slide gate of claim 1, said ledges in the direction of feed being symmetrical in the direction of feed.

4. In the slide gate of claim 2, said ledges in the direction of feed being symmetrical in the direction of feed.

5. In a full throttle tundish valve having a pluraltiy of yieldable means, a top plate, a sliding plate, and a pour tube having a holder, said yieldable means engaging the downstream side of that plate portion of the submerged pour tube holder to apply sealing force to the submerged pour tube holder, the sliding gate, and the stationary top plate, a loading portion, a teeming and throttling portion perpendicular with the loading portion, the improvement comprising, opposed rails in the loading portion of said tundish valve for engaging and loading a slide gate in the direction of loading, said rails being asymmetrical when viewed from the direction of loading the slide gate to thereby accommodate a slide plate which has asymmetrical undercut ledges in the direction of loading, and means for blocking off one end of the lefthand/-righthand loading of said tundish valve, whereby the asymmetrical loading rails insure that a slide plate having an orifice only be loaded into the valve in one configuration of the relationship of the orifice to the loading portion of the valve.

6. A method of preventing reversilibilty of a slide gate having an orifice in a valve having a loading direction and a feeding direction for the slide gate comprising the steps of, fixing asymmetrical ledges in parallel relationship to the underneath portion of a slide plate in the direction of loading, fixing the loading rails in the valve to conform to the offset ledges in the slide plate in the direction of desired loading, closing the loading portions of the valve opposite the portion in which loading is desired, and fixing rails for engaging the opposite underneath portions of the slide gate in perpendicular relationship to the rails of feed.

7. In the method of claim 6 above, offsetting the orifice in said slide plate along the direction of loading and throttling.

8. In the method of claim 6 above, securing the rails for feed and the ledges for feed perpendicular to the direction of throttling in symmetrical relationship.

9. A slide gate with a loading and feeding direction for a slide plate essentially perpendicular to each other comprising, in combination, a frame of essentially rectangular configuration surrounding and retaining a refractory, a refractory inserted interiorly of and secured to said frame, said refractory having an orifice, ledges of unequal width on opposing edge portions below the top surface of the slide gate parallel to the axis in the direction of loading, and ledges of equal or near equal width on opposing edge portions below the top surface of the slide gate parallel to the axis in the direction of feed which is essentially perpendicular to the axis in the direction of loading.

10. In the slide gate of claim 9, said ledges parallel to the axis in the direction of feed being of lesser width than the wider of the two ledges parallel to the axis in the direction of loading.

11. In the slide gate of claim 9, said orifice being centrally located along the intended axis of throttling.

12. In the slide gate of claim 9, said ledge in the direction of feed being symmetrical about the axis in the direction of feed.

13. In the slide gate of claim 10,
said ledges in the direction of feed being symmetrical about the axis in the direction of feed.

14. In the method of claim 6,
forming the rails for feed and the ledges for feed of a lesser width than the wider of the two rails for loading and ledges for loading which are parallel to the direction of loading and throttling.

15. A slide gate for use in a sequential sliding gate valve having asymmetrical means for inserting said gate along a direction of leading, and thereafter having means for insertion in a direction for feeding, and thereafter a direction of throttling comprising,
and useful in a frame of essentially rectangular configuration surrounding and retaining a refractory, comprising:
a refractory inserted interiorly of and secured to said frame,
said refractory having an orifice,
ledges in asymmetrical configuration underneath the frame and refractory at the edge portions thereof and parallel to the direction of loading,
and ledges in the direction of feeding which are essentially in perpendicular relationship to the asymmetrical loading ledges.

16. In the slide gate of claim 15,
said orifice being offset along the intended direction of throttling.

17. In the slide gate of claim 15,
said leges in the direction of feeding being symmetrical in the direction of feeding.

18. In the slide gate of claim 15,
said ledges in the direction of feeding being symmetrical in the direction of feeding.

19. In a full throttle tundish valve having a plurality of yieldable means for engaging the downstream side of a plate portion of a submerged pour tube holder to apply sealing force to the submerged pour tube holder, a sliding gate, and a stationary plate, a loading portion, a feeding portion said feeding portion including a teeming and throttling portion perpendicular with the loading portion, the improvement comprising,
opposed rails in the loading portion of said tundish valve for engaging and loading a slide gate,
said rails in the loading portion of said tundish valve for engaging and loading a slide gate,
said rails being asymmetrical when viewed from the direction of loading the slide gate to thereby accommodate a slide plate which has asymmetrical undercut ledges in the direction of loading,
and means for blocking off one end of the lefthand/-righthand loading of said tundish valve, whereby the asymmetrical loading rails insure that a slide plate having an orifice only be loaded into the valve in one configuration of the relationship of the orifice to the loading portion of the valve.

20. A method of preventing reversibility of a slide gate in a sequential valve having a loading direction and a feeding direction essentially perpendicular to the loading direction, comprising the steps of,
forming asymmetrical ledges in parallel relationship to the underneath portion of a slide plate in a direction of loading,
securing loading rails in the valve to conform to the offset ledges in the slide plate in the direction of desired loading,
engaging means for closing the loading portions of a valve opposite the portion in which loading is desired,
and securing rails for engaging the opposite underneath portions of the slide gate in perpendicular relationship to the rails of the feed.

21. In the method of claim 20 above,
offsetting the orifice in said slide plate along the direction of loading and throttling.

22. In the method of claim 20 above,
fixing the rails for feed and the ledges for feed perpendicular to the direction of throttling in symmetrical relationship.

23. A refractory slide gate for use in a sequential sliding gate valve having asymmetrical means for inserting said gate along a direction of loading and thereafter having means for inserting aong a direction of feeding, and thereby a direction of throttling comprising, in combination,
a frame of essentially rectangular configuration surrounding and retaining a refractory,
said refractory slide gate having an orifice,
ledges of unequal width on opposing edge portions below the top surface of the slide gate parallel to the direction of loading,
and ledges of equal or near equal width on opposing edge portions below the top surface of the slide gate parallel to the direction of feeding which is essentially perpendicular to the axis in the direction of loading.

24. In the slide gate of claim 23,
said ledges parallel to the axis in the direction of feed being of lesser width than the wider of the two ledges parallel to the axis in the direction of loading.

25. In the slide gate of claim 23,
said orifice being centrally located along the intended axis of throttling.

26. In the slide gate of claim 23,
said ledge in the direction of feed being symmetrical about the axisin the direction of feeding.

27. In the slide gate of claim 24,
said ledges in the direction of feed being symmetrical about an axis in the direction of feeding.

28. In the method of claim 20,
forming the rails for feed and the ledges for feed of a lesser width than the wider ot the two rails for loading and ledges for loading which are parallel to the direction of loading and throttling.

29. A slide gate for use in a sequential sliding gate valve having asymmetrical means for inserting said gate along a direction of loading and thereafter having means for inserting in a direction of loading and thereafter having means for inserting in a direction of feeding, and thereby a direction of throttling comprising, in combination,
a frame of essentially rectangular configuration surrounding and retaining a refractory,
a refractory inserted interiorly of and secured to said frame,
said refractory having an orifice,
ledges having differing cross-sectional configuration underneath the frame and refractory at the edge portions thereof and parallel to the direction of loading,
and ledges in the direction of feeding which are essentially in perpendicular relationship to the loading ledges of differing cross-section.

30. In the slide gate of claim 29,
said orifices being offset along the intended axis of throttling.

31. In the slide gate of claim 29,
said ledges in the direction of feed being symmetrical in the direction of feed.

32. In the slide gate of claim 29,
said ledges in the direction of feed being symmetrical in the direction of feed.

33. In a full throttle tundish valve having a plurality of yiedlable means for engaging the downstream side of a plate portion of a submerged pour tube holder to apply sealing force to the submerged pour tube holder, a slide gate, and a stationary top plate, a loading portion, a teeming and throttling portion perpendicular with the loading portion, the improvement comprising,
opposed rails in the loading portion of said tundish valve for engaging and loading a slide gate,
said rails being asymmetrical and of differing cross-section when viewed from the direction of loading the slide gate to thereby accommodate a slide plate which has undercut edges of differing cross-section in the direction of loading. whereby the asymmetrical loading rails insure that a slide plate having an orifice only be loaded into the valve in one configuration of the relationship of the orifice to the loading portion of the valve.

34. A method of preventing reversilibity of a slide gate in a valve having a frame, means for loading a slide gate, and means for feeding a slide gate respectively in a direction of loading and feeding, comprising the steps of,
forming ledges of differing cross-section in parallel relationship to the underneath portion of a slide plate in the direction of loading,
forming the loading rails in the valve to conform to the ledges of differing cross-section in the slide plate in the direction of desired loading,
actuating means for closing the loading portions of a valve opposite the portion in which loading is desired,
and forming rails for engaging the opposite underneath portions of the slide gate in perpendicular relationship to the rails of feed.

35. In the method of claim 89 above,
offsetting the orifice in said slide plate along the direction of loading and throttling.

36. In the method of claim 34 above,
forming the rails for feed and the ledges for feed perpendicular to the direction of throttling symmetrical relationship.

37. A slide gate for use in a sequential sliding gate valve having asymmetrical means for inserting said gate along a direction of loading and thereafter means for guiding said gate in a direction of feeding, and thereafter a direction of throttling comprising, in combination,
a frame of essentially rectangular configuration surrounding and retaining a refractory,
a refractory inserted interiorly of and secured to said frame,
said refractory having an orifice,
ledges of unequal dimension on opposign edge portions below the top surface of the slide gate parallel to an in the direction of loading,
and ledges of functionally equal width on opposing edge portions below the top surface of the slide gate parallel to an axis in the direction of feed which is essentially perpendicular to the axis in the direction of loading.

38. In the slide gate of claim 37,
said ledges parallel to the axis in the direction of feed being of lesser dimension than the greater of the two ledges parallel to the axis in the direction of loading.

39. In the slide gate of claim 37,
said orifice being centrally located along the intended axis of throttling.

40. In the slide gate of claim 37,
said ledge in the direction of feed being symmetrical about the axis in the direction of feed.

41. In the slide gate of claim 38,
said ledges in the direction of feed being symmetrical about the axis in the direction of feed.

42. In the method of claim 29,
forming the rails for feed and the ledges for feed of a lesser dimension than the greater of the two rails for loading and ledges for loading which are parallel to the direction of loading and throttling.

* * * * *